United States Patent [19]

Müller

[11] Patent Number: 4,630,798

[45] Date of Patent: Dec. 23, 1986

[54] METHOD AND DEVICE FOR ERECTING BUILDING STRUCTURES SUCH AS BRIDGES, USING PRE-FABRICATED CONCRETE BEAMS

[75] Inventor: Eberhard Müller, Cologne, Fed. Rep. of Germany

[73] Assignee: Philipp Holzmann Aktiengesellschaft, Frankfurt, Fed. Rep. of Germany

[21] Appl. No.: 667,123

[22] Filed: Nov. 1, 1984

Related U.S. Application Data

[62] Division of Ser. No. 389,083, Jun. 16, 1982, Pat. No. 4,497,153.

[30] Foreign Application Priority Data

Jun. 19, 1981 [DE] Fed. Rep. of Germany ..... 3124038

[51] Int. Cl.[4] ..... E01D 21/02

[52] U.S. Cl. ..... 249/50; 14/1; 14/23; 264/33; 249/79; 249/172; 425/111

[58] Field of Search ..... 52/749; 14/1, 23; 264/33; 249/50, 172, 79; 425/111

[56] References Cited

U.S. PATENT DOCUMENTS 3,989,218 11/1976 Muller ..... 14/1

*Primary Examiner*—John E. Murtagh

*Assistant Examiner*—Caroline Dennison

*Attorney, Agent, or Firm*—Merchant, Gould, Smith, Edell, Welter & Schmidt

[57] ABSTRACT

Proposed is a method for the erection of structures, such as bridges, that display pre-fabricated concrete beams, according to which the individual pre-fabricated beams are produced, on the spot, on a feed rigging within the corresponding work area of the structure, in a heated and laterally tiltable form. After removal from the form, the thusly produced pre-fabricated beams are transferred sidewardly into their final position by means of gantry cranes. During concretizing of the individual pre-fabricated beams, flexure of the feed rigging carrying the form is equalized in continuous fashion, in correspondence with the progressing, concretizing process, by transfer pumping of ballast liquid. Correspondingly with progression of construction, the feed rigging displaying a freely suspended cantilever is transferred in progressive fashion onto support girders of the structure that have been prepared beforehand, just like the gantry cranes, which can be pretransported from the support girders supporting it to the next support girders. Also capable of being equalized are different inclinations of the support girders, such as curvatures in the ground plane of the structure, for example the access to bridges.

13 Claims, 6 Drawing Figures

Figure 1A:
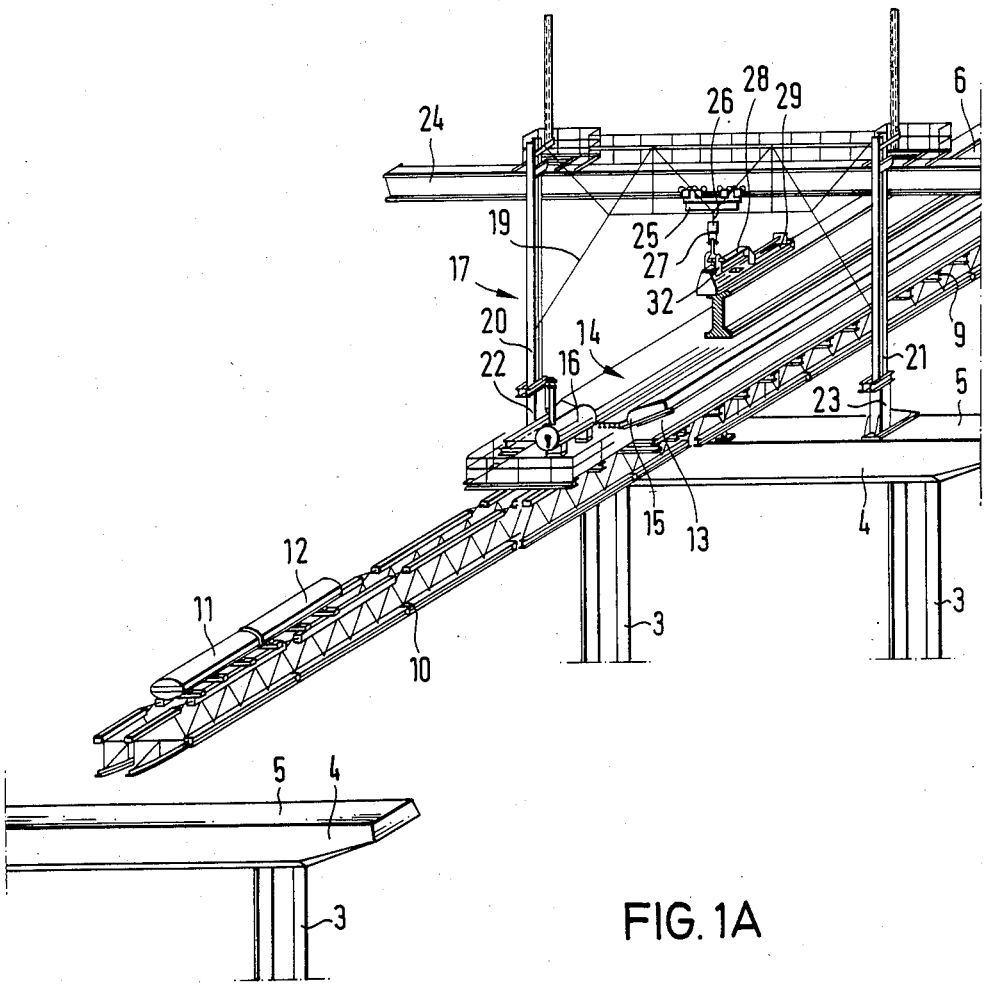
Figure 1B:
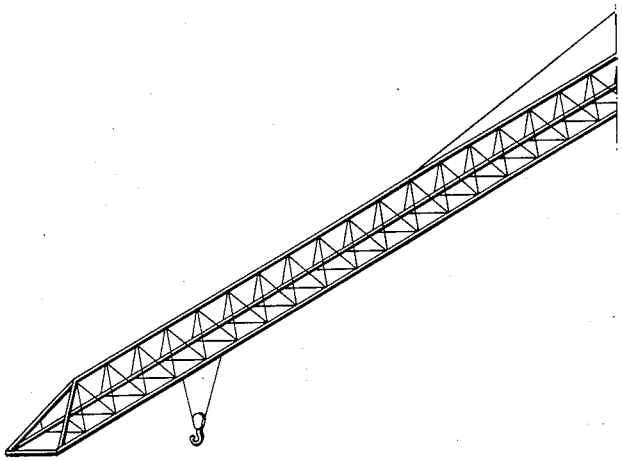
Figure 1B:
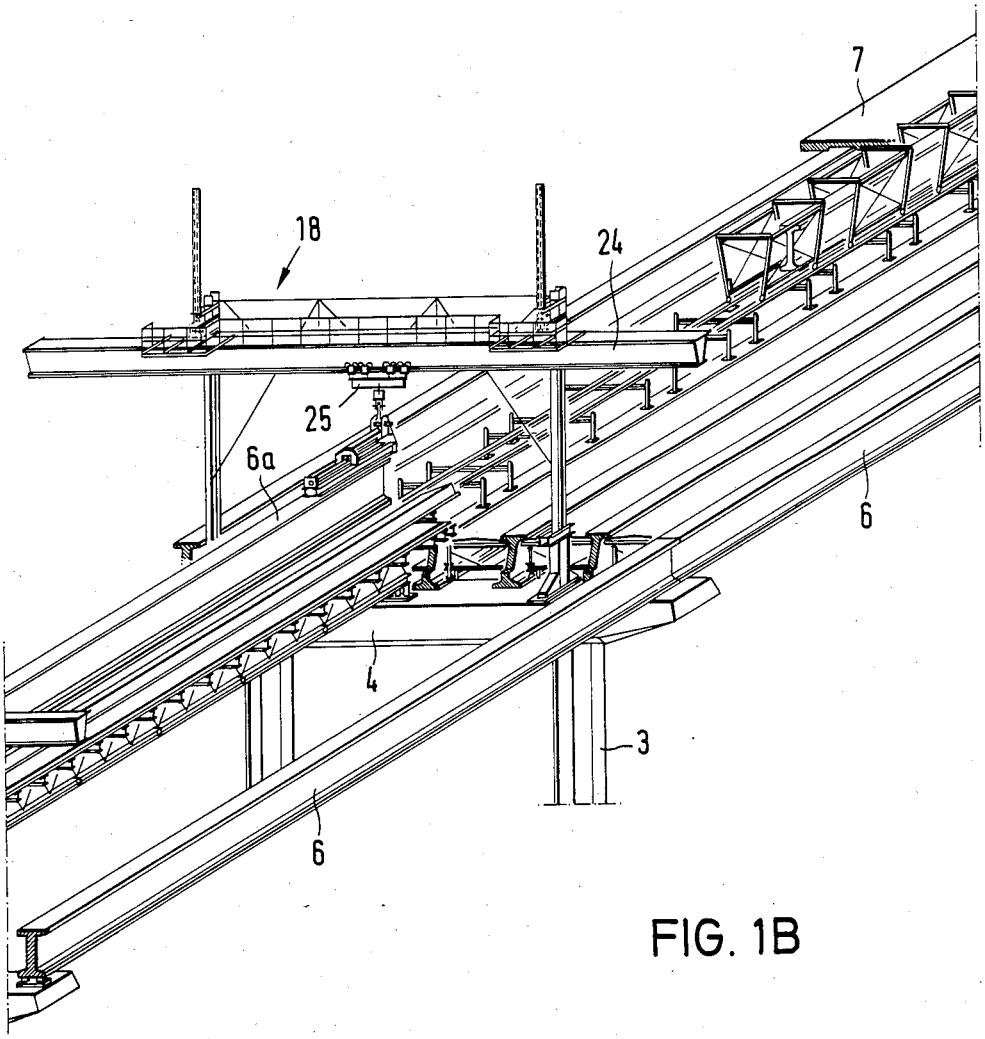
Figure 1C:
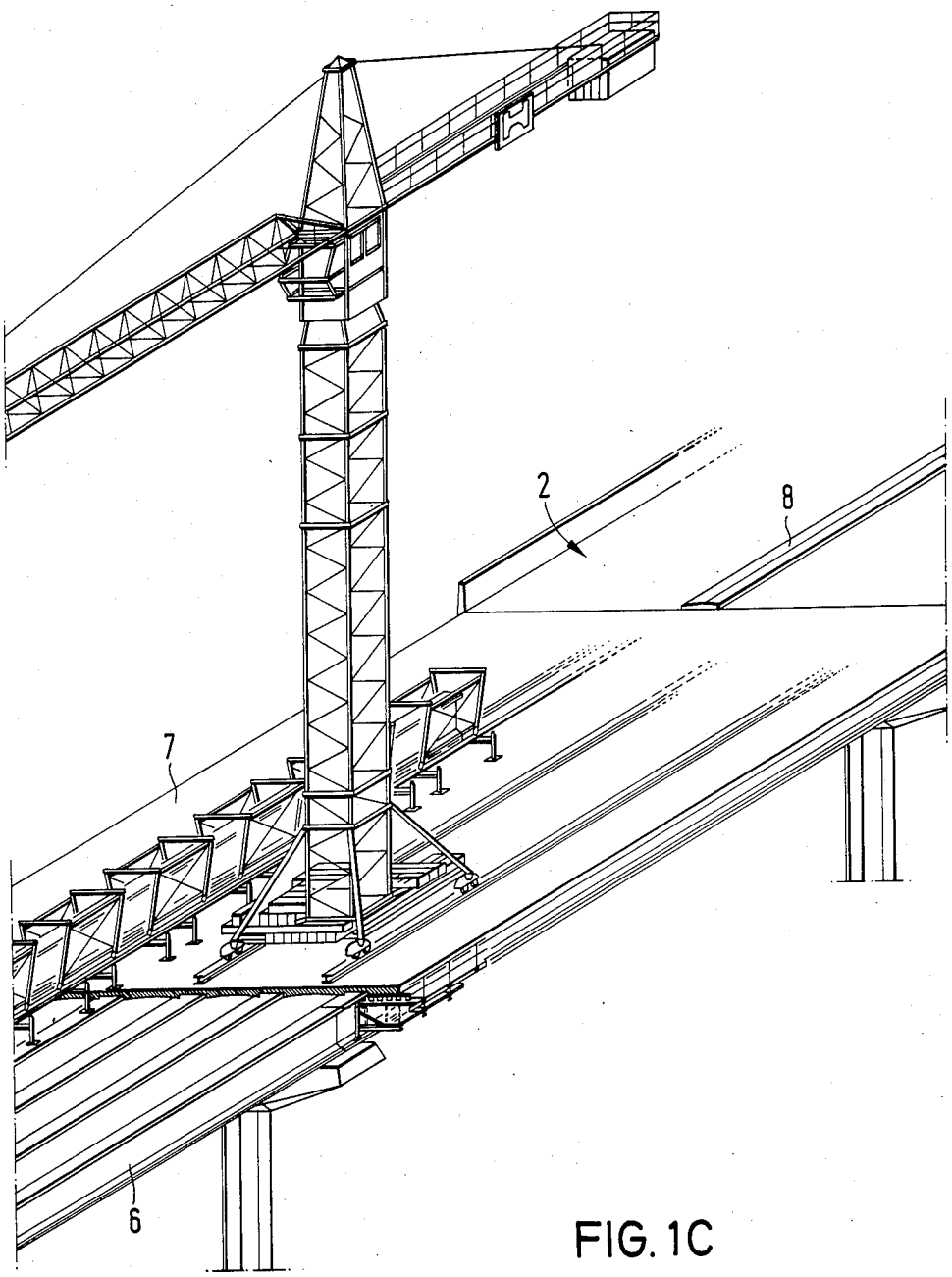

METHOD AND DEVICE FOR ERECTING BUILDING STRUCTURES SUCH AS BRIDGES, USING PRE-FABRICATED CONCRETE BEAMS

This is a division of application Ser. No. 389,083, filed June 16, 1982, now U.S. Pat. No. 4,497,153.

The invention concerns a method for erecting structures such as bridges, using pre-fabricated concrete beams. The invention additionally concerns a device for carrying out this method.

It is known how to erect concrete beams for bridge structures, on the spot, by means of a cantilevered form in the actual bridge bay (German Pat. No. 1 658 629). In doing this, it is necessary to eliminate deformation of the cantilevered form during concentration, until setting of the concrete, by prestressing the form, which casts forth practical problems because loading of the form changes with pouring of the concrete so that it is difficult to set the correct prestress. The task set forth for the invention is to simplify the erection of structures, such as bridges, displaying pre-fabricated concrete beams and, thereby, being capable of undertaking adaptation to the prevailing local condiitions when erecting the individual sections of the structure.

This task is resolved in accordance with the invention by the fact that the individual, pre-fabricated beams are produced, on the spot, on a feed rigging in the respective work area of the structure, in a heated and sidewardly tiltable form, and they are then transferred and/or placed in the final position within this working area. The pre-fabricated beams in accordance with the present invention are therefore produced in the actual working field of the structure, however transferred to their final position only after hardening and/or setting. The feed rigging carrying the reusable form, while concretising of the individual pre-fabricated beams, lies within the area of the respective beams to be erected and to be emplaced.

Placement of the individually produced pre-fabricated beams preferentially follows after removing the form through means of two gantry cranes that are anchored on support girders of the respective working area, i.e. on support girders that are located on the vertical supports of the structure such as the bridge. In this fashion, the individual pre-fabricated beams can be produced very exactly, on the spot, in correspondence to the prevailing local conditions and finally placed with the required accuracy on the supporting girders of the structure.

According to another feature of the invention, flexure of the rigging supports of the feed rigging can be continuously equalized during concretizing of the pre-fabricated beams which, by way of example, can be achieved by a special construction of the feed rigging. Here, for stressing the respective, concretized, pre-fabricated beams, the return spring force of the feed rigging can be reduced continuously with the stressing process in order to achieve a uniform prestressing of the pre-fabricated beams while concretizing.

According to another feature of the invention, for the purpose of carrying out the method in accordance with the invention, the feed rigging that is structured as a feed beam is provided with a projecting cantilever on which are located, just like between the two support girders of the structure, tanks for a liquid that is used as ballast, with these tanks being connected together by means of lines and, for example, with pumps being provided for pumping the ballast liquid selectably into the individual tanks and, in this fashion, to equalize the flexure of the rigging beam continuously, in correspondence with the progress of the concretizing process by pumping the ballast liquid into the tanks located on the cantilever.

According to another feature of the invention, the heated and tiltable form is provided with fixedly installed external vibrators and consists of a main part and a head piece that is removably joined with this latter, with which the top flanges of the pre-fabricated beams are produced. The external vibrators effect a good and uniform compaction of the poured concrete, while the removable head piece enables variably adjusting flange inclination of the pre-fabricated beams. Since the head piece is to be separated from the main part of the form, the form, even in the case of a fixed bottom point of rotation, can be tilted downwardly with any inclination of the flange of the pre-fabricated beams. After unlocking the connecting element provided between the main part and the head piece, the head piece, when the form tilts up, slides down on an inclined sliding surface by a predetermined amount and, after ending the tilt-up process, slides back into its initial position. After locking the head piece with the main part of the form, the form is again ready for use.

In accordance with yet another feature of the invention, each one of the two gantry cranes has a trolley carriage suspended hinge-fashion ahead of its supports so that this trolley carriage always hangs perpendicularly, independently of the deformation of the crane supports. The supporting feet of each gantry crane are preferentially constructed to be telescopically extendable so that different vertical heights occassioned by lateral tilt of the support beams of the structure can be equalized.

For moving the gantry cranes into a new working position, i.e. hence onto other support girders of the structure, the trolley carriage of each gantry crane is laid onto a transport cart by means of two lifting spindles. Then, through means of these two lifting spindles, the crane rigging is lifted from its anchoring and the entire thing is then transported to a new emplacement location. The lifting spindles also enable an arbitrary upward or downward movement of the crane rigging when transporting to the new emplacement location.

If the structure is curved in the ground plane, the pre-fabricated beams of each structural area are of unequal length. Additionally, the two gantry cranes are not parallel to each other. This requires a construction that permits different lengths for the pre-fabricated beams and that also enables a methodical, horizontal displacement of the load attack point of the lifting tools and/or gantry cranes relative to the ends of the pre-fabricated beams. For this purpose, provided in accordance with the invention, inside of equalizing traverses, are horizontal hydraulic presses.

Provided for the perpendicular alignment of the hook type bottom block of the trolley and/or the electric hoists of the gantry cranes is an appropriate displacement transducer that contacts the cable of the respective electrical hoist and that is preferentially suspended in pendulum fashion. This displacement transducer controls the perpendicular direction of the hook type bottom block, with a measurement/control control arrangement evaluating the measured path and automatically controls the hydraulic presses.

Proposed by means of the invention is an improved, simple method for the purpose of being capable of erecting structures such as bridges, which display pre-fabricated concrete beams, in correspondence to the local conditions. Also proposed are useful devices for carrying out this method which enable rapid work.

Figure 2:
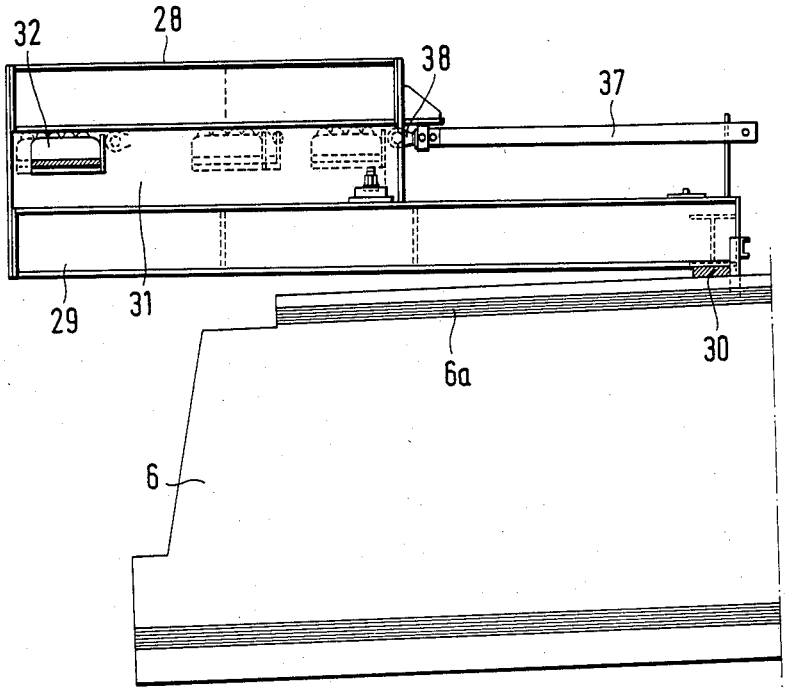
Figure 3:
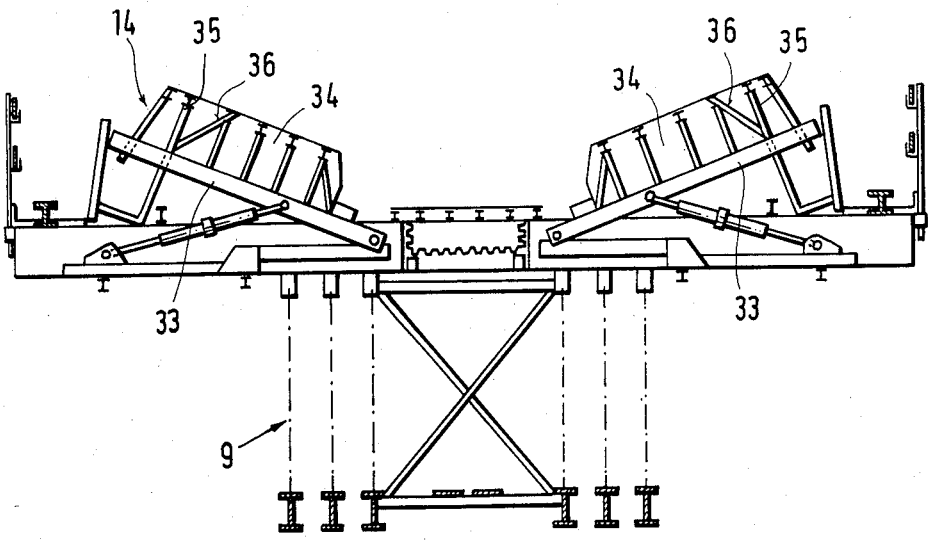
Figure 4:
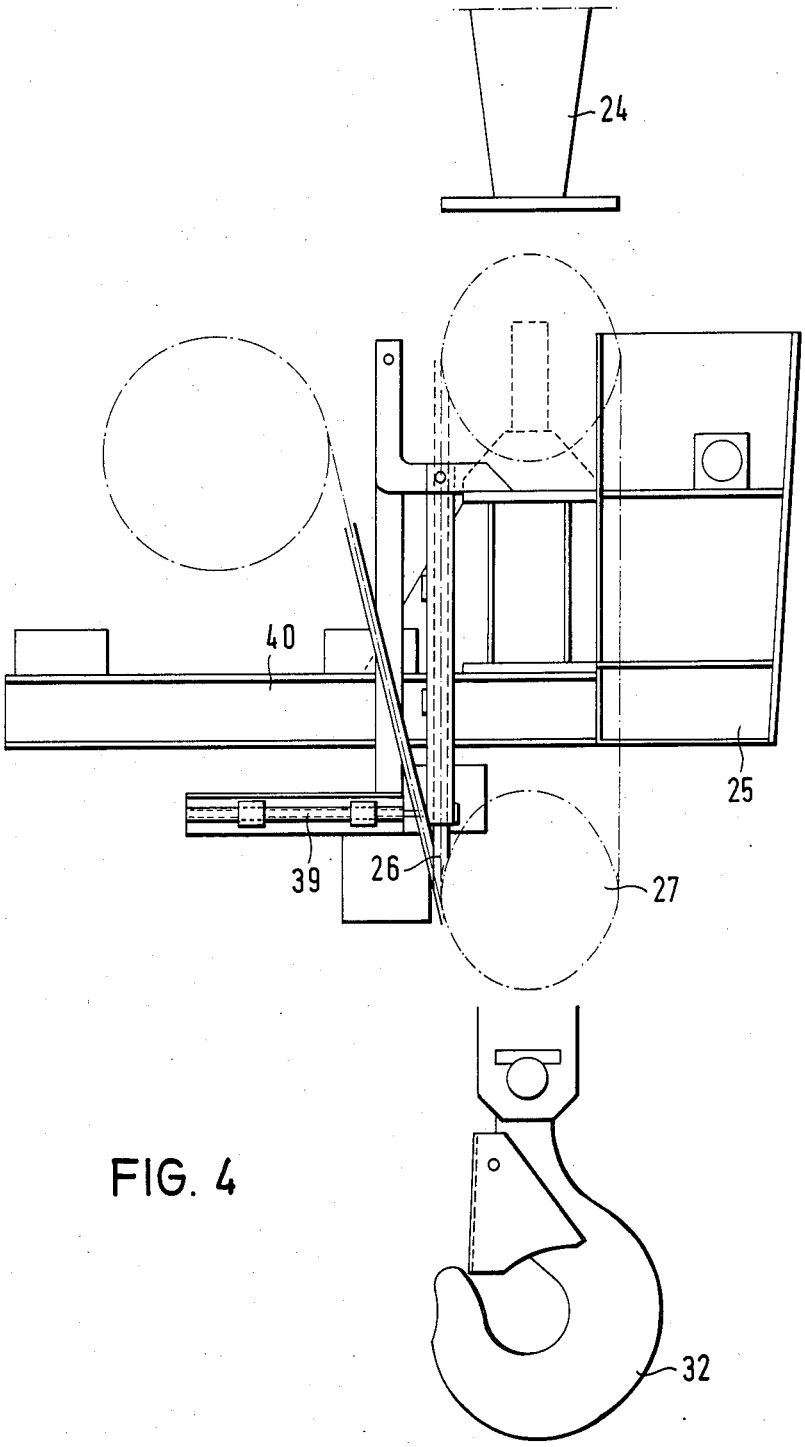

Further features of the invention will be explained with the aid of the drawing. Shown are:

FIG. 1 in partial FIGS. A, B and C, a pictorial overall view of erection of a bridge in accordance with the invention, the superstructure of which displays pre-fabricated beams on vertical supports and support girders running transversally and joining these latter, said beams being poured from concrete in the respective bridge bay and, after hardening, are removed from the form and placed in the final installation position, FIG. 2 a partial view, in an enlarged scale, of the one end of a pre-fabricated beam removed from the form, which is suspended on a gantry crane by means of a grab, FIG. 3 a front view of the heated form for production of the pre-fabricated beams, which is illustrated in the tilted-up position, and FIG. 4 a schematic side view of the control arrangement for vertical alignment of the cable lines and hook type bottom blocks of the trolleys of the gantry cranes.

Capable of being recognized from FIG. 1 is that a bridge 2 is being erected on vertical supports 3 that are connected together in pairs at their top ends via approximately horizontally running support girders 4. The surface 5 of the individual support girders 4 can run horizontally or also inclined toward one or the other side, depending upon whether the corresponding bridge section runs straight or describes a curve.

First, laid next to each other on the support girders 4 are cast concrete, pre-fabricated beams 6 that are produced in the corresponding bridge bay and then, in a manner described in more detail below, emplaced at the location of use. Then, installed on the thusly emplaced pre-fabricated beams 6 is a laminar covering 7 that forms the underlayment for roadway 8 construction.

Used for producing the individual, pre-fabricated beams 6 is a feed rigging 9 that is structured in the form of a feed beam and that displays a freely projecting cantilever 10 on whose outer ends are installed two ballast tanks 11 and 12.

The feed rigging 9 is provided with a top plate 13 on which is mounted a tiltable and heatable form 14, with FIG. 1 showing the main part 15 of this form in the tilted-up condition. A generator 16 serves to produce hot oil with which the wall of the main part 15 of form 14 is heated.

Capable of being recognized from FIG. 1 is that the feed rigging 9 lies on the support girders 4 of successive support pairs, while cantilever 10 projects in the direction toward the next support member.

Capable of being pumped into the ballast tanks 11 and 12 in continous fashion is a liquid serving as ballast, in a manner not illustrated in any further detail, for the purpose of continuously equalizing flexure of the feed beam or rigging beam when pouring concrete into the form 14. When the cast, pre-fabricated beam is stressed, the ballast fluid is pumped out of ballast tanks 11 and 12 to the center of the area of the associated bridge bay so that the return spring force of the rigging is continuously reduced with the stressing process.

Mounted on the sequential support pairs 3 for the support girders 4, spanned over by the feed rigging 9, is a gantry crane 17 and 18, respectively, which can be transferred to the next following support girder with progression of bridge construction. Each gantry crane 17 and 18, respectively, has a bearing scaffolding 19 with two vertical supports 20 and 21 whose feet 22 and 23, respectively, are structured telescopically in order to be able to compensate for different vertical heights because of transverse inclination of the support girders 4 and/or their surface 5.

Suspended hinge-fashion on the support scaffolding 19, ahead of supports 20 and 21, is a trolley carrier 24 which, independent of the actual extension length of supports 20 and 21, always remains horizontal.

Journalled to the under side of each trolley carrier 24 is a trolley 25 capable of travelling in the longitudinal direction of the trolley carrier 24, so that the individual, pre-fabricated beams 6 produced in the form 14 can be transferred to the final position sidewardly from the feed rigging 9 after removal from the form.

The gantry cranes 17 and 18 are arranged such that the trolley carriers 24 are installed on the sides of the support scaffolding 19 facing each other, so that the supports 20 and 21 do not hinder lateral transfer of the pre-fabricated beams 6.

Suspended on each trolley 25, via a cable line 26 to be driven electrically, is a hook type bottom block 27 that cooperates with an equalizing traverse 28 of a grab 29. The grab 29 can be installed on the top flange **6*a* of the pre-fabricated beam 6 in order to lift the pre-fabricated beam 6 out from the opened form 14** and to be able to transfer it to the desired place of use.

To be recognized in FIG. 2 are the particulars of the equalizing traverse 28 provided on the grab 29. Here, the grab 29 is attached to the top flange **6*a* of a pre-fabricated beam 6 over a thrust block 30**.

The equalizing traverse 28 is provided with an opening 31 running in the longitudinal direction, in which the hook 32 of the hook type bottom block 27 engages. To be recognized from FIG. 2 is that the hook 32 can lie in different positions inside the opening 31 in order to enable an equalization in length when raising, transporting and lowering the pre-fabricated beams 6.

To be recognized from FIG. 3 is that the form 14, illustrated here tilted-up, displays, on the inner side of each one of the two lateral walls 33 a main part 34 projecting inwardly and, for example to be heated with heating oil, that is firmly joined with the associated side wall 33, and a removable head piece 35 that sits, in displaceable and replaceable fashion, over a sloped surface 36, on the main part 34. By replacement of the head pieces 35, it is possible to produce, on the spot, in correspondence to the prevailing operating conditions, pre-fabricated beams 6 having differently shaped and/or inclined top flanges **6*a***.

In order to be able to produce in a particular area of construction whose ground plane is curved pre-fabricated beams of different length and to be able to displace them laterally by means of gantry cranes that are not parallel to one another, i.e., therefore, in order to be able, when transferring, to equalize different beam lengths and, thereby, to also be able to methodically undertake a horizontal displacement of the load attack point of crane hook 32 relative to the ends of the pre-fabricated beams 6 that have been completed, arranged on the top side of each grab 29 is a hydraulically actuated cylinder 37 whose extendable piston rod 38 acts against the hook 32 and holds the hook 32 inside of opening 31 in the correct position, as is indicated in FIG. 2 by the three different positions shown there. The hydraulic cylinders 37 are actuated in controlled fashion by means of a measurement and control arrangement that compares the actual position of the hook type bottom block 27 to the perpendicular and afterwards undertakes control of the hydraulic cylinder 37 in order that the hook type bottom block 27 and, therewith, the cable line 26 continually hang perpendicularly. For this purpose, as shown in FIG. 4, provided is an inductive displacement transducer 39 that detects deflections of the cable 26 from the perpendicular. Further provided is a pendulum rod 40. The position at any given time of cable 26 is sensed and controlled by means of the electric, inductive displacement transducer 39 suspended pendulum fashion on the pendulum rod 40. A measurement and control arrangement that is not illustrated in any more detail evaluates the results of measurement and then automatically controls the hydraulic pressure cylinder 37 in order, therewith, to move the crane hook 32 into the correct position on the equalizing traverse 28.

I claim:

1. An apparatus for erecting a structure at a site using pre-fabricated beams, comrpising:

(a) a feed rigging in the associated work area of the structure, said feed rigging comprising:

(i) a form for forming the pre-fabricated beams; and (ii) a support scaffolding operatively supporting said form;

(b) means operatively connected to said support scaffolding for continuously equalizing flexure of said support scaffolding during concretizing of the pre-fabricated beams; and (c) means operatively proximate to said feed rigging for emplacing the pre-fabricated beams in their final position in the work area.

2. The apparatus in accordance with claim 1, wherein said equalizing means reduces a return spring force of said support scaffolding.

3. The apparatus in accordance with claim 1, wherein said equalizing means comprises a cantilevered member extending from said support scaffolding.

4. The apparatus in accordance with claim 3, wherein said cantilevered member comprises:

(a) a first tank suitable for containing a ballast liquid; and (b) means for selectively changing the amount of said ballast liquid in said first tank during concretizing of the pre-fabricated beam.

5. The apparatus in accordance with claim 4, further comprising a second tank in fluid communication with said first tank, wherein said changing means comprises a pump for transferring said ballast liquid from said first tank to said second tank.

6. The apparatus in accordance with claim 1, wherein said form is heated and laterally tiltable.

7. The apparatus in accordance with claim 6, wherein said feed rigging further comprises an external vibrator fixedly attached to said form.

8. The apparatus in accordance with claim 7, wherein said pre-fabricated beams comprise top flanges and said form comprises a main part and a head piece removably joined thereto for forming the top flanges of the pre-fabricated beams.

9. The apparatus in accordance with claim 1, wherein said emplacing means comprises a pair of gantry cranes that are anchored on a plurality of support girders of a corresponding area of the structure.

10. The apparatus in accordance with claim 9, wherein each of said gantry cranes comprises:

(a) a pair of supports;

(b) a pair of feet operatively connected to said corresponding supports;

(c) a trolley carrier in hinge-like suspension ahead of said supports; and (d) a trolley in operative contact with said trolley carrier.

11. The apparatus in accordance with claim 10, wherein said feet of each of said gantry cranes are telescopically extendable.

12. The apparatus in accordance with claim 11, wherein said trolley of each of said gantry cranes comprises an equalizing traverse, a hoist having a cable and a hook-type bottom block, wherein each of said gantry cranes comprises means for controlling said corresponding equalizing traverse comprising a displacement transducer in operative proximity to said corresponding cable.

13. The apparatus in accordance with claim 12, wherein said trolley of each of said gantry cranes further comprises a pendulum rod and said displacement transducer is suspended in pendulum fashion from said pendulum rod.

* * * * *